US005576037A

United States Patent [19]

Moore, Jr. et al.

[11] Patent Number: 5,576,037

[45] Date of Patent: Nov. 19, 1996

[54] SHRINK BAG WITH INTEGRAL HANDLE AND METHOD OF MAKING SAME

[75] Inventors: Donald B. Moore, Jr., Moore; Jeffrey D. Gebauer, Greer; John P. Carson, Spartanburg, all of S.C.

[73] Assignee: W. R. Grace & Co.-Conn., Duncan, S.C.

[21] Appl. No.: 191,448

[22] Filed: Feb. 3, 1994

Related U.S. Application Data

[63] Continuation of Ser. No. 924,130, Aug. 3, 1992, abandoned.

[51] Int. Cl.[6] ..... B65B 53/00; B65D 65/00; B65D 75/00; B65D 79/00

[52] U.S. Cl. ..... 426/110; 426/129; 426/412; 426/413; 53/442; 53/557; 206/497; 383/8; 383/9; 383/10; 383/17

[58] Field of Search ..... 426/106, 110, 426/129, 410, 412, 413; 383/6–10, 12, 14, 17, 25, 908; 53/442, 557; 206/497

[56] References Cited

U.S. PATENT DOCUMENTS

| | | | |
|---|---|---|---|
| Re. 26,674 | 9/1969 | Ilg | 150/2 |
| 3,066,845 | 12/1962 | Mattaway | 229/55 |
| 3,358,906 | 12/1967 | Faiers | 229/62 |
| 3,502,258 | 3/1970 | Kugler et al. | 383/10 |
| 3,506,185 | 4/1970 | Christensen | 383/908 |
| 3,549,085 | 12/1970 | Hart | 229/54 |
| 3,650,775 | 3/1972 | Simon et al. | 426/129 |
| 3,670,947 | 6/1972 | Tangredi et al. | 229/54 |
| 3,815,313 | 6/1974 | Heisler | 53/14 |
| 3,863,837 | 2/1975 | Spiegel et al. | 229/87 |
| 4,232,721 | 11/1980 | Martin et al. | 150/0.5 |
| 4,516,267 | 5/1985 | Kent et al. | 383/22 |
| 4,555,025 | 11/1985 | Weimberg et al. | 206/497 |
| 4,652,490 | 3/1987 | Arita et al. | 426/129 |
| 4,772,133 | 9/1988 | Volk | 383/6 |
| 4,779,996 | 10/1988 | Sengewald | 383/9 |
| 4,867,575 | 9/1989 | Wood | 383/17 |
| 4,958,735 | 9/1990 | Odabashian | 206/497 |
| 4,974,968 | 12/1990 | Mandus et al. | 383/9 |
| 5,120,553 | 6/1992 | Kupcikevicius | 426/129 |

FOREIGN PATENT DOCUMENTS

| | | | |
|---|---|---|---|
| 1029919 | 4/1978 | Canada . | |
| 1200232 | 2/1986 | Canada . | |
| 475266A1 | 3/1992 | European Pat. Off. . | |
| 0475266 | 3/1992 | European Pat. Off. . | |
| 64-9163 | 1/1989 | Japan | 383/6 |
| 1150368 | 4/1969 | United Kingdom . | |
| 1396290 | 6/1975 | United Kingdom . | |
| 2028755 | 3/1980 | United Kingdom . | |

*Primary Examiner*—Anthony J. Weier
*Attorney, Agent, or Firm*—Mark B. Quatt

[57] ABSTRACT

A shrink bag having an integral carrying handle is provided that includes an extended skin portion of the bag of a heat shrinkable thermoplastic material and having a carrying hole in the skirt portion with an essentially continuous heat seal around its margin, the carrying hole having a configuration which helps to distribute stress and substantially eliminates tear propagation. The bag is particularly adapted for packaging whole turkeys and the like and, to this end, the integral carrying handle is preferably located at the breast containing end of the bag.

21 Claims, 5 Drawing Sheets

SHRINK BAG WITH INTEGRAL HANDLE AND METHOD OF MAKING SAME

This application is a Continuation of application Ser. No. 924,130, filed on Aug. 3, 1992, now abandoned.

BACKGROUND OF THE INVENTION

1. Field of the Invention

The present invention relates generally to a thermoplastic packaging bag having a carrying handle and relates specifically to a heat shrinkable packsking bag having an integral carrying handle.

2. Description of the Related Art

An accepted method of vacuum packaging bulky food articles such as whole muscle meat products, brick cheese and poultry, is through the use of heat shrinkable bags. The food processor loads the food article into the bag and evacuates the bag to collapse it about the food product. The bag is sealed while in its evacuated condition by gathering the open end and clipping or by leaving flat and heat sealing. The sealed bag is then passed through a hot water bath or hot air tunnel or other method of heating to shrink the sealed bag about the food product. Shrinking the bag in this fashion closely conforms the bag to the contour of the food product thereby making an attractive, generally wrinkle-free package.

Poultry items such as turkeys and other whole birds present several problems for this type of packaging. For example, the poultry carcass is generally the shape of a tear drop having a broad rounded breast portion tapering to the tail of the bird. The tear drop shape is accentuated by the customary practice of folding the legs of the bird close to the body and binding the end of the legs to the tail of the bird. This tear drop shape does not lend itself to formation of a substantially wrinkle free package.

A bag fabricated to accommodate a whole bird, generally has front and rear panels composed of a heat shrinkable plastic film which are heat sealed together at the closed end of the bag. It is common to have the closed end of the bag convex to accommodate the broad rounded breast of the bird. The opposite open end of the bag must be wide enough to receive the bird which is inserted breast first into the bag. The open end of the bag is then gathered about the tall of the bird and closed with a metal clip. This procedure pulls the bag close to and along the more tapered parts of the bird. Heat shrinking the pulled and gathered bag material provides an aesthetically pleasing appearance to the packaged bird.

Another problem related to packaging turkeys and the like in shrink bags is that the resulting packaged product is bulky, relatively heavy, usually frozen, and difficult to grasp and lift manually. Therefore it is desirable to provide a carrying handle to facilitate handling the vacuum packaged product. For this purpose several different methods of providing a carrying been developed. A separate handle may be attached to the packaged product at the clip closure. The packaged product may be inserted into a netting which is gathered and clipped to provide a carrying handle. An integral handle may be produced by cutting a cut out in the gathered flap portion of the bag and reinforcing the periphery of the cut out with a grommet to inhibit tear initiation under carrying or hanging load conditions. All of these methods of prodding a carrying handle require additional processing steps and materials thereby increasing the packaging costs.

Preferably, the handle should be formed integral with the bag to avoid the added expense and processing steps of attaching a separate handle to the packaged product. Furthermore, an integral handle should not require additional material reinforcing devices and the consequent additional processing steps in packaging the product. Also preferably, the integral handle is located on the breast end of the packaged bird. This allows the packaged bird to be carried with the tail end down protecting the valuable breast of the product from damage due to impacting hard objects during display, and transportation.

U.S. Pat. No. 4,555,025 (Weinberg et. al.) discloses a shrink bag having an integral handle forming portion. The bag is an "extended lip bag" wherein one panel extends beyond the bag open end. As disclosed in this patent, the handle is formed in the extended lip portion by punching a hot die through the lip to provide an opening having a heat seal extending continuously about the opening. This patent also discloses an integral handle wherein both bag panels extend past the product holding area of the bag. The handle is then formed in this dual panel extended lip portion by punching a hot die through the lip to provide an opening having a heat seal extending continuously about the handle opening. When this method is used to produce the integral handle a slit in one panel of the bag below the fused handle area is required to allow for the product to be placed therein. In either method upon heat shrinking, the extended lip thickens and forms a handle which protrudes longitudinally from the resulting package.

U.S. Pat. No. 5,120,553 (Kupcikevicius) discloses a shrink bag having an integral handle forming portion. The bag is also a so called "extended lip bag" wherein the bag is shaped to receive the bird in a tail first entry mode and the extended lip portion which has a slit that forms the integral handle is located at the bird tall end of the package. However, the industry practice of packaging turkeys and other poultry, with their wings folded and positioned against the sides of the breast area prevents easy loading of the bird into a bag in a tail first manner. Additionally, breast first loading allows the protective skin flap over the neck bone to remain in position to help prevent bag damage by this sharp neck bone. As a result commercial packing of turkeys and other poultry is done in a breast first loading orientation. The teaching requires that the handle so formed is drawn to the package seal area, preferably over the packaged product itself and does not extend away from the packaged product to allow for easy package pick up by the integral handle. This patent also does not appreciate the advantageous handle cut out shape which distributes handle stress more evenly and substantially reduces tear propagation in the shrink bag film.

U.S. Pat. No. 4,974,968 (Mandus et. al.), discloses a thermoplastic bag with a handle hole and narrow lugs having holes therein. The narrow lugs may be either end of the bag to allow it to be suspended for filling. Bags of this type are useful for packaging baby diapers for example. Likewise U. S. Pat. No. 4,779,996 (Sengewald), discloses a plastic foil pouch having pin holes at one end of the pouch to allow it to be suspended for filing. Examples of products suitable for packaging include baby diapers and bread. Neither of these patents appreciates the novel handle of the present invention, nor does it address the problem of load stress on the bag handle during transportation of a heavy product.

OBJECTS AND SUMMARY OF THE INVENTION

One object of the present invention is to provide a shrink bag having an integral handle.

Another object is to provide a shrink bag having an integral handle positioned so as not to occlude any portion of the bag opening.

Yet another object of the present invention is to provide a shrink bag with an integral carrying handle wherein the bag is especially adapted for packaging whole body poultry such as turkeys and the like in a breast first loading orientation.

A further object of the present invention is to provide a shrink bag having an integral handle portion located at the end of the bag opposite its open end.

A still further object is to provide a shrink bag having an integral handle which stands away from the surface of the resulting package to allow for easy handle access and which looks like a handle.

Yet a further object is to provide a shrink bag having an integral handle of such a geometry as to distribute more efficiently hang weight stresses and substantially to eliminate tear propagation of the shrink bag film.

One form of the present invention relates to a shrink bag having an open end for loading a product into the bag, a dosed end and wherein a handle forming portion of the bag is adjacent said closed end. The bag of the present invention may be used for a variety of food products, such as for example, whole body poultry, ham, whole turkey breasts, turkey breasts from emulsion, smoke & processed meats, and the like. The bag of the present invention is particularly adapted for use in packaging whole body poultry such as turkeys and the like. For this reason the bag is described in reference to a preferred packaging use as a turkey or a whole body poultry bag.

To facilitate its use as a turkey bag, the shrink bag of the present invention has a dosed end preferably formed to receive the rounded breast portion of the bird. The closed end of the bag preferably is formed by heat sealing wherein the heat seal is generally concave across the bag to form a bag pocket for receiving the breast end of the bird. A skirt portion extending from this heat seal contains a hot die cut opening which forms a handle opening, this hot die cut opening having a heat seal extending substantially continuously about the margin of the opening. It is to be appreciated that the handle opening may be cut using a cutting knife or other hole cutting device or method known in the art. The opening further has a configuration which produces a generally "D" shaped opening which minimizes the amount of material required in the skirt and which more efficiently distributes hang load stresses and substantially eliminates tear propagation in the shrink bag film. Further, while the preferred embodiment utilizes a heat seal extending substantially continuously about the margin of the opening, a handle opening without said heat seal is also contemplated by, and suitable for, the present invention.

Thus, the bag handle is formed from the material of the skirt at the closed end of the bag. With this preferred arrangement the bird is loaded breast first through the bag opening. The bag is evacuated and then the bag opening is closed, preferably by gathering it around the tall end of the bird and closing with a metal clip. On subsequent heat shrinking, the resulting flange of bag material around the tall of the bird is considerably reduced to produce a substantially wrinkle free, attractive packaged product.

Moreover, providing the integral handle at the breast end of the bird allows for the packaged bird to have printing positioned such that the bird may be displayed and the printing read with the breast toward the consumer, instead of the breast away from the consumer. This positioning of the handle at the breast end of the bird, unlike the traditional netting handle at the hock end of the bird, alleviates the potential for damage to the most valuable breast portion of the bird. Furthermore, the bird is carried breast up and therefore alleviates the potential for damage to the valuable breast area caused by the lower, downward end of the packaged bird striking countertops, etc. during transportation and storage by both the retailer and the consumer.

Additionally, where the skirt is defined by heat seals, the heat seal extending around the margin of the handle opening substantially eliminates the collection of hot water, used to shrink the product-loaded shrink bag, in the extended flap portion of the bag and thereby substantially eliminates a potential safety hazard to workers packaging the products in said heat shrink bags.

Another form of the present invention relates to a heat shrinkable bag comprising: congruent front and rear panels of a thermoplastic heat shrinkable material superimposed and laying flat one against the other and defining the front and rear of a bag pocket, the panels having longitudinal side edges Joined fluid-tight to form bag pocket side edges and the panels having common ends including a first end adjacent but longitudinally spaced from a closed bottom of said bag pocket, said first end having a first continuous transverse heat seal, and an opposite open end; a second continuous transverse heat seal connecting fluid-tight said front and rear panels adjacent to but spaced from said first end, said second heat seal defining the closed bottom of said bag pocket; a skirt formed solely from and defined by said congruent front and rear panels between said first transverse heat seal and said second transverse heat seal; and said skirt having a handle integral to said bag at said first closed end, said handle being composed of the skirt portion of said congruent front and rear panels extending outwardly from said heat seal in a direction away from said second closed end which skirt portion has a handle cut out having a shape defined by a top arc having a radius (A) of from about (1.75×R) to about (2.25×R) describing that part of the handle cut out most distant from said second transverse heat seal, a first side arc having a radius of about (R) located to the right of the center point of said top are with its center point about (A-R) from the center point of salad top are on a line perpendicular to said longitudinal side edges, a second side are having a radius of about (R) located to the left of the center point of said top are with its center point about (A-R) from the center point of said top are on a line perpendicular to said longitudinal side edges, and a straight line intersecting the two arcs having radii (R) on a tangent and said straight line parallel to the center points of said arcs having radii (R) and the center point of said top arc; thereby producing an integral handle which distributes the load stresses and substantially eliminates tear propagation in the thermoplastic heat shrinkable material.

Yet another form of the present invention relates to a bag for containing a poultry carcass comprising: congruent front and rear panels of a heat shrinkable thermoplastic film having joined lateral edges, an open end and a closed end: said closed end formed by longitudinally spaced first and second heat seals connecting said bag panels, each of said seals extending transverse to said panels from one lateral side edge to another; sad second heat seal forming a generally concave pocket contoured to receive the generally broad rounded breast portion of a poultry carcass inserted breast first through said open end; said heat seals defining a skirt therebetween at the end of said bag opposite said open end, said skirt having a handle forming cut out therein for carrying said bag after heat shrinking about a poultry carcass sealed within said bag pocket; said handle cut out having a shape defined by a top arc having a radius (A) of from about (1.75×R) to about (2.25×R) describing that part of the handle cut out most distant from said second transverse heat seal, a first side arc having a radius of about (R) located to the right of the center point of said top arc with its center point about (A-R) from the center point of said top arc on a line perpendicular to said longitudinal side edges, a second side arc having a radius of about (R) located to the left of the center point of said top arc with its center point about (A-R) from the center point of said top arc on a line perpendicular to said longitudinal side edges, and a straight line intersecting the two arcs having radii (R) on a tangent and said straight line parallel to the center points of said arcs having radii (R) and the center point of said top arc.

A yet further embodiment of the present invention relates to a poultry carcass containing package comprising: a poultry carcass including breast and tail portions inserted and vacuum packaged in a heat shrunk bag composed of congruent front and rear panels of a heat shrinkable thermoplastic film; said bag having a transverse heat seal contoured to accommodate the shape of said carcass breast portion and forming a first closed end of a bag pocket, said heat seal being made prior to inserting said poultry carcass into said bag and said heat seal being contoured to accommodate an end of said carcass; said bag having a second closed end formed after the insertion of said poultry carcass into said bag; and a handle integral said bag at said first closed end, said handle being composed of a skirt portion of said congruent front and rear panels extending outwardly from said heat seal in a direction away from said second closed end which skirt portion has a handle cut out having a shape defined by a top arc having a radius (A) of from about (1.75×R) to about (2.25×R) describing that part of the handle cut out most distant from said second transverse heat seal, a first side arc having a radius of about (R) located to the right of the center point of said top arc with its center point about (A-R) from the center point of said top arc on a line perpendicular to said longitudinal side edges, a second side arc having a radius of about (R) located to the left of the center point of said top arc with its center point about (A-R) from the center point of said top arc on a line perpendicular to said longitudinal side edges, and a straight line intersecting the two arcs having radii (R) on a tangent and said straight line parallel to the center points of said arcs having radii (R) and the center point of said top are.

The present invention further encompasses a method of making a heat shrinkable bag having an integral carrying handle comprising: providing congruent front and rear bag panels of a thermoplastic heat sealable material which are superimposed and lay flat one against the other, said panels being joined fluid-tight along side edges to form sides of a bag pocket and having common ends including a first end and an opposite open end; heat sealing said bag panels together at said first end with a first continuous transverse heat seal, and with a second continuous transverse heat seal adjacent to, but longitudinally spaced from, said first end thereby forming a continuous transverse heat seal which defines a fluid-tight dosed bottom of said bag pocket and a skirt formed solely from said congruent front and rear panels between said second heat seal and said first end; and cutting in said skirt a handle cut out having a shape defined by a top arc having a radius (A) of from about (1.75×R) to about (2.25×R) describing that part of the handle cut out most distant from said second transverse heat seal, a first side are having a radius of about (R) located to the right of the center point of said top are with its center point about (A-R) from the center point of said top are on a line perpendicular to said longitudinal side edges, a second side arc having a radius of about (R) located to the left of the center point of said top are with its center point about (A-R) from the center point of said top arc on a line perpendicular to said longitudinal side edges, and a straight line intersecting the two arcs having radii (R) on a tangent and said straight line parallel to the center points of said arcs having radii (R) and the center point of said top arc.

A further method embodied by present invention relates to forming a food product containing package with integral carrying handle comprising: providing a bag having congruent front and rear panels of a heat shrinkable thermoplastic film defining the sides of a food product receiving bag pocket, the bag having: i) a dosed bag pocket bottom formed by a transverse heat seal contoured to accommodate an end of a food product inserted into said bag pocket through a bag open end opposite the dosed bag pocket bottom, and ii) a skirt at the closed bag pocket bottom being an extension of the congruent front and rear panels from sad heat seal, said skirt including a second end of said bag and said skirt having a bag handle forming cut out; inserting a food product through said bag open end; evacuating said bag to collapse it about said food product and then effecting an air-tight closure of said bag open end; and then heat shrinking said product containing bag to form a taut, generally wrinkle-free package; thereby providing a handle for gripping and lifting said food containing package.

Thus the heat shrinkable bag having an integral carrying handle of the present invention provides an integral handle which is formed from both panels of the bag, located at the prepackaging closed end of the bag. This handle has a handle cut out which is a hole as opposed to a slit, located in the skirt formed between the two transverse heat seals, neither of which has to be parallel to the handle. Further, the integral handle works best when it does not shrink over and across the packaged product, but instead protrudes longitudlnally and is thus accessible for the user at the end of the bag. These features further result in a heat shrinkable bag having an integral carrying handle which prevents high stress concentrations and prevents tear propagation when the handle is subjected to abusive conditions.

Preferred forms of the shrink bag with integral handle, as well as other embodiments, objects, features and advantages of this invention, will be apparent from the following detailed description, and illustrative embodiments thereof, which are to be read in connection with the accompanying drawings.

BRIEF DESCRIPTION OF THE DRAWINGS

The invention will be more fully understood from the following description and accompanying drawings wherein.

DESCRIPTION OF THE PREFERRED EMBODIMENTS OF THE INVENTION

Figure 1:
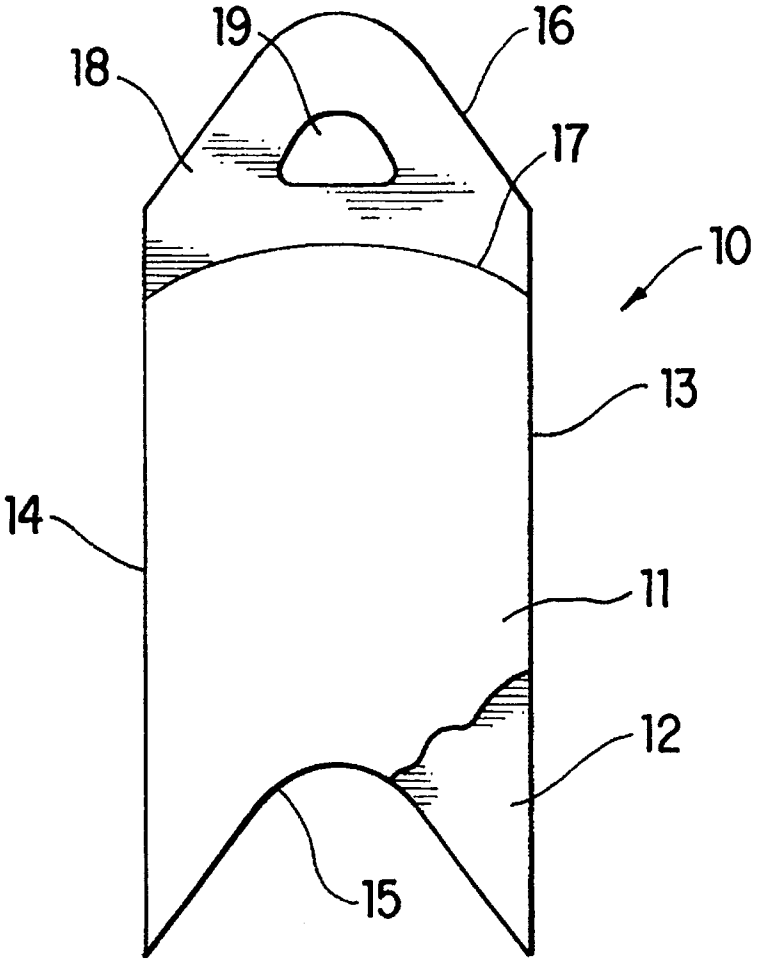
FIG. 1 is a schematic front view of a preferred embodiment of a heat shrinkable extended skirt bag having a generally D shaped handle cut out in the extended skirt, as the bag would appear prior to heat shrinkage about a contained product.

The present invention will be better understood from the specification taken in conjunction with the accompanying drawings in which like reference numerals refer to like parts.

In FIG. 1 there is shown a bag of the present invention generally indicated at 10 in its lay-flat condition prior to its packaging use. The bag is made of any suitable heat shrinkable thermoplastic packaging film commonly used for vacuum packaging food products. Suitable films include for example, an oriented barrier film having low oxygen permeable,by such as that disclosed in U.S. Pat. No. 3,741,253 (Brax et. al.), and heat-shrinkable films containing very low density polyethylene and a barrier layer such as a polyvinylidene chloride copolymer or an ethylene vinyl alcohol copolymer such as that disclosed in U.S. Pat. No. 4,863,769 (Lustlg et. al.). For turkey and other poultry packaging a hi-axially oriented multi-layer film such as disclosed, for example, in U.S. Pat. No. 4,617,241 (Mueller) is preferred. A cook-in film, such as that disclosed in U.S. Pat. No. 4,879,124 (Oberle), could also be used, particularly where the intended end use is cook-in of packaged poultry.

Generally, such films are formed as blown tubes, which are made heat-shrinkable using one of the various well known bubble methods. The tube is collapsed to a lay-flat condition to provide superimposed front and rear bag panels having seamless side edges. The laid-flat tube is then heat-sealed liquid-tight across its width to form a closed bag end and then it is severed at a location spaced from the heat seal to provide an open bag end.

In accordance with this practice, FIG. 1 shows the bag 10 to have superimposed front and rear panels 11 and 12 respectively. The front and rear panels are congruent and lay flat one against the other.

The panels are joined along lateral side edges 13 and 14. If the bag is made of a collapsed tube as noted above, the side edges 13 and 14 are seamless. Otherwise one or both side edges 13 and 14 contain a liquid-tight seam such as is formed by heat sealing or an adhesive for connecting the panels.

The congruent bag panels 11 and 12 have common ends 15 and 16 wherein end 15 is the open end of the bag. The panels at end 16 are optionally connected such as by heat sealing the panels together. The shape of the end 16 is not critical and can be any shape that provides the desired amount of material to create a handle capable of distributing the load stresses and carrying the weight of the packaged product. This desired shape of end 16 may be determined without undo experimentation and is well known and understood in the art. The currently preferred shape minimizes the amount of non-functional skirt material such as for example, by heat seal 16.

The front and rear panels 11 and 12 are connected by a heat seal generally indicated at 17 which extends across the bag inboard of the end 16. This heat seal 17 defines the closed bottom of the bag pocket for containing an article to be packaged which is inserted into the bag through the open end 15. The sides of the bag pocket are formed by bag panels 11 and 12.

The heat seal 17 forming the bottom of a bag pocket may extend straight across the bag. Preferably the heat seal is shaped to conform generally with an end of an article to be inserted into the bag pocket and against the bottom of the bag. In one embodiment of the bag for use in packaging whole poultry, the heat seal provides a rounded cavity shape able to accommodate the breast configuration of the breast end of a bird such as a turkey or the like.

In this respect, FIG. 1 shows that the heat seal 17 has a standard medium triple radius arc shape seal well known and understood in the art which produces a shape contoured to accommodate the shape of said carcass breast portion. The result is that the closed bottom of a bag pocket as defined by heat seal 17 provides a concave pocket able to accommodate the breast end portion of a turkey or the like when the bag is open from its lay-flat condition.

The portion of the bag panels 11 and 12 between heat seal 17 and end 16 defines a skirt 18 at the end of the bag opposite open end 15. The skirt includes the bag end 16 and contains a handle cut out 19 generally centrally located on the bag's longitudinal center line and located as close to seal 17 as is practical. The handle cut out is formed by a hot knife which bums through the bag panels and in the process welds the panels together at the handle cut out margin. As described hereinbelow, the handle cut out forms an opening to facilitate use of the skirt as a bag handle for carrying an article sealed within the bag.

The placement and configuration of the handle cut out 19 is important to a proper functioning of the skirt 18 as a bag handle. For example, the handle cut out 19 should be centrally located from the edges 13 and 14 when the bag is in a lay-flat position. The position of the handle cut out 19 in relation to the heat seal 17 is not critical and for example, may be adjacent to heat seal 17 or may be spaced away from heat seal 17. The length of the skirt 18 may be of any desired length, but for economy and ease of processing should be as short as possible. A preferred length for the skirt 18 is about 5 inches. It is to be understood that the skirt 18 need be long enough that the band of skirt material comprised of congruent panels 11 and 12 extend at least ½ inch beyond the top of handle cut out 19. The adjustment of these parameters to provide an appropriate location for the handle cut out 19 in order to provide a handle able to distribute the load stresses and support the weight of the packaged product is well within the skill of the art.

Figure 2:
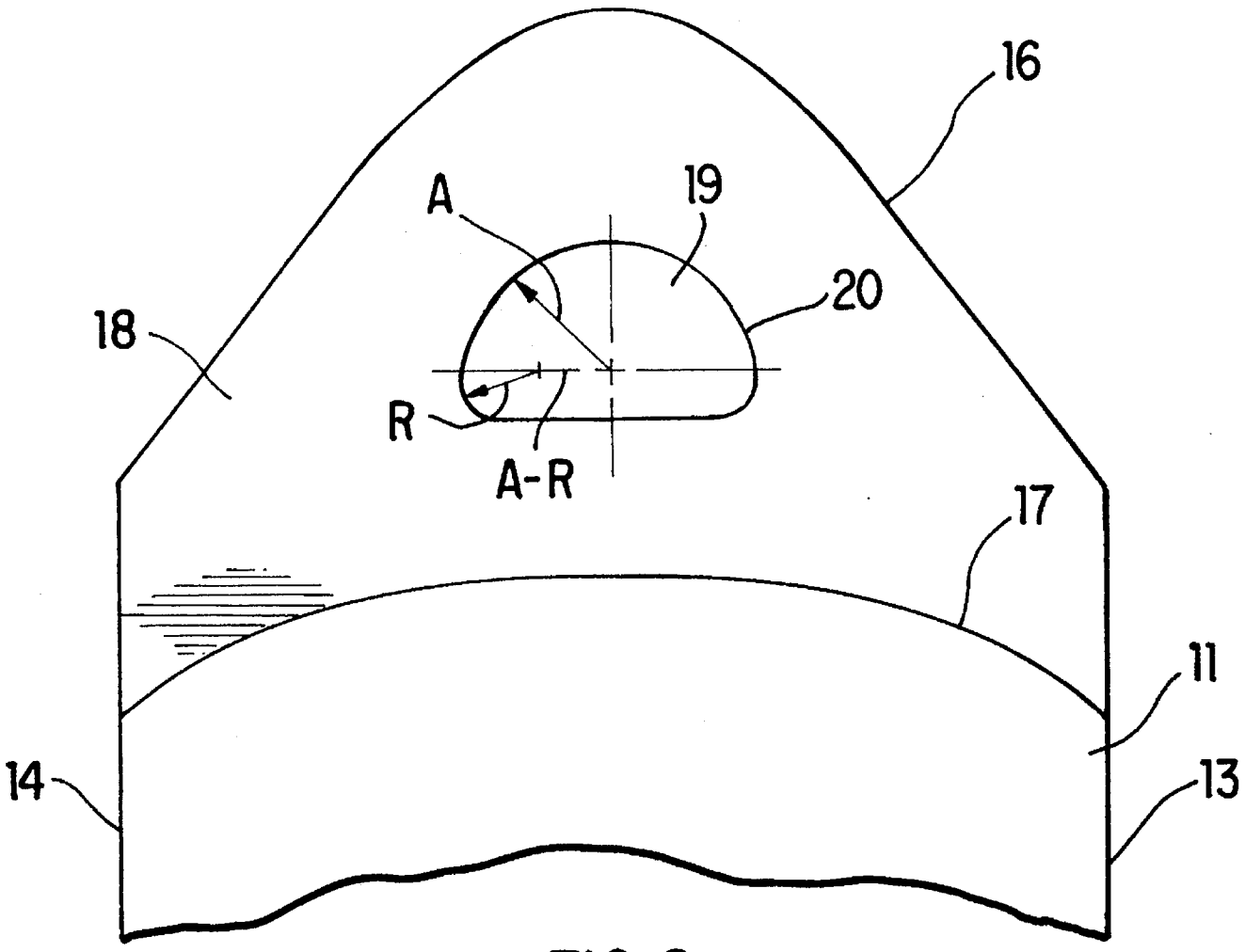
FIG. 2 is a schematic front view of the extended skirt portion of FIG. 1 showing the generally D shaped handle cut out.

FIG. 2 shows the skirt 18 portion of the bag 10 and the handle cut out 19 in greater detail. The handle cut out 19 is preferably formed by a hot knife which burns through the bag panels 11 and 12 and in the process welds the panels together at the handle cut out margin defined by a heat seal 20. Heat seal 20 may be a single heat seal or it may be 2 or more concentrically located heat seals, if necessary to prevent tear propagation in the shrink film bag 10. It is to be appreciated that it is presently preferred to have heat seal 20 extend completely around handle cut out 19, thereby providing a completely sealed skirt portion 18 of bag 10. This preferred embodiment prevents hot water from collecting between panels 11 and 12 in the skirt area 18 during the hot water shrinking of bag 10 around the packaged product and thereby prevents the operators from receiving hot water bums while handling the bags 10 after the heat shrinking process. It is to be understood however, that the handle cut out 19 does not require the heat seal 20 to be continuous and that discontinuous heat seals 20 are also contemplated as suitable for use in the present invention.

It has been surprisingly found that the particular configuration of the handle cut out 19 described by the present invention substantially eliminates tear propagation in the skirt 18 and further substantially reduces stress concentrations which can lead to tear propagation in the bag panels 11 and 12 and catastrophic bag failure. This handle cut out configuration may be described as having a shape defined by a radius A, of from about (1.75 R) to about (2.25×R) describing that part of the handle cut out most distant from heat seal 17 (hereinafter the "top" arc of the handle cut out 19); a first side arc having a radius of about (R) located to the right of the center point of said top arc with its center point about (A-R) from the center point of said top arc on a line perpendicular to longitudinal side edges 13 and 14, a second side arc having a second radius of about (R) located to the left of the center point of said top arc with its center point about (A-R) from the center point of said top arc on a line perpendicular to longitudinal side edges 13 and 14, and a straight line intersecting the two arcs having radii (R) on a tangent and said straight line parallel to the center points of said arcs having radii R and the center point of said top arc. This shape may be thought of as generally similar to a capital D laying on its back. It has been found that a radius R of less than 1 inch permits the tearing of the handle at these areas when the handle is stressed. Therefore the radius R needs to be at least 1 inch. The currently preferred radius A is about 2¼ inches. It has further been found that the distance between the end of the skirt and the top of the handle cut out must be sufficient to prevent failure of the handle under stress conditions. This distance should be at least about 2½ inch and preferably is at least about 1¼ inches. providing a total skirt length of about 5 inches to about 6 inches.

Alternatively, if the distance between the end of the skirt and seal 17 is increased to a total skirt length of about 6¼ inches a round handle cut out may be used. This round handle cut out when used on a bag made to accept the bird in a breast first loading method will reshape to the D shape necessary to produce the easily accessible yet strong handle of the present invention upon heat shrinking of the bag around the bird. It is to be appreciated however, that this method of producing the D shape works best for a breast first loaded bird and requires at least 1¼ inches more bag material to realize the necessary strength to resist tear propagation under load stresses.

Figure 3:
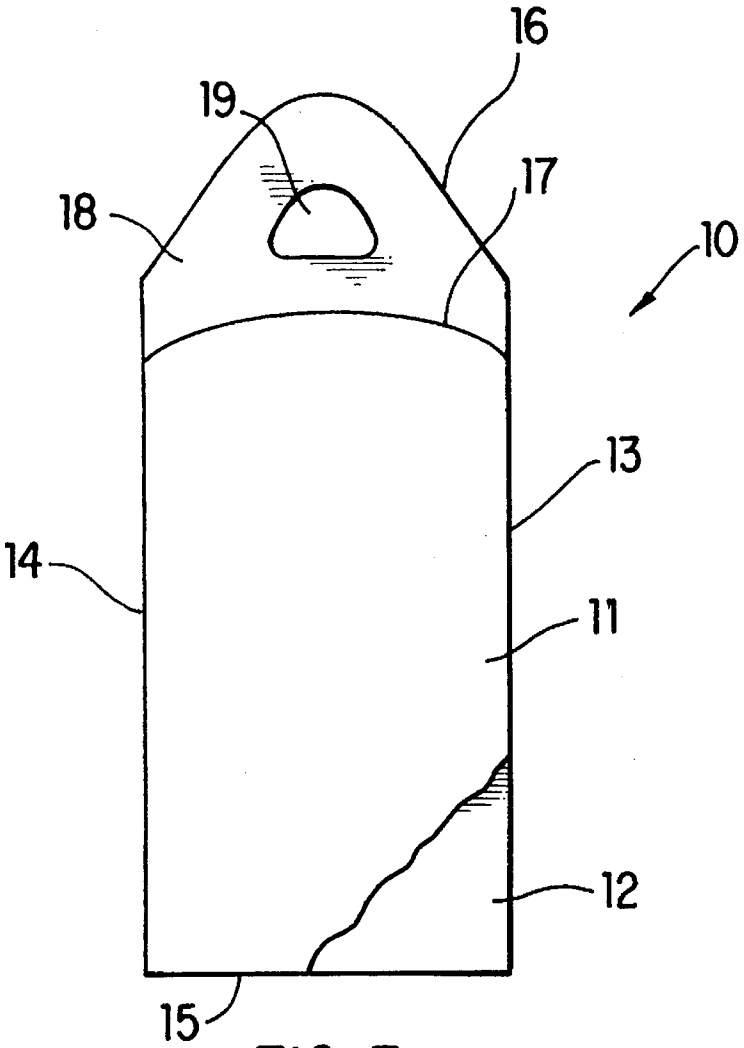
FIG. 3 is a schematic front view of a second embodiment of a heat shrinkable extended skin bag having the generally D shaped handle cut out in the extended lip as the bag would appear prior to heat shrinkage about a contained product.

FIG. 3 shows another embodiment of the present invention wherein the bag 10 has superimposed front and rear panels 11 and 12 respectively. The front and rear panels are congruent and lay flat one against the other.

The panels are joined along lateral side edges 13 and 14. If the bag is made of a collapsed tube as noted above, the side edges 13 and 14 are seamless. Otherwise one or both side edges 13 and 14 contain a seam such as is formed by heat sealing or an adhesive for connecting the panels.

The congruent bag panels 11 and 12 have common ends 15 and 16 wherein end 15 is the open end of the bag and is cut straight across and perpendicular to edges 13 and 14. The end 15 when cut in this manner provides less scrap to the packager during his packaging process.

Figure 4:
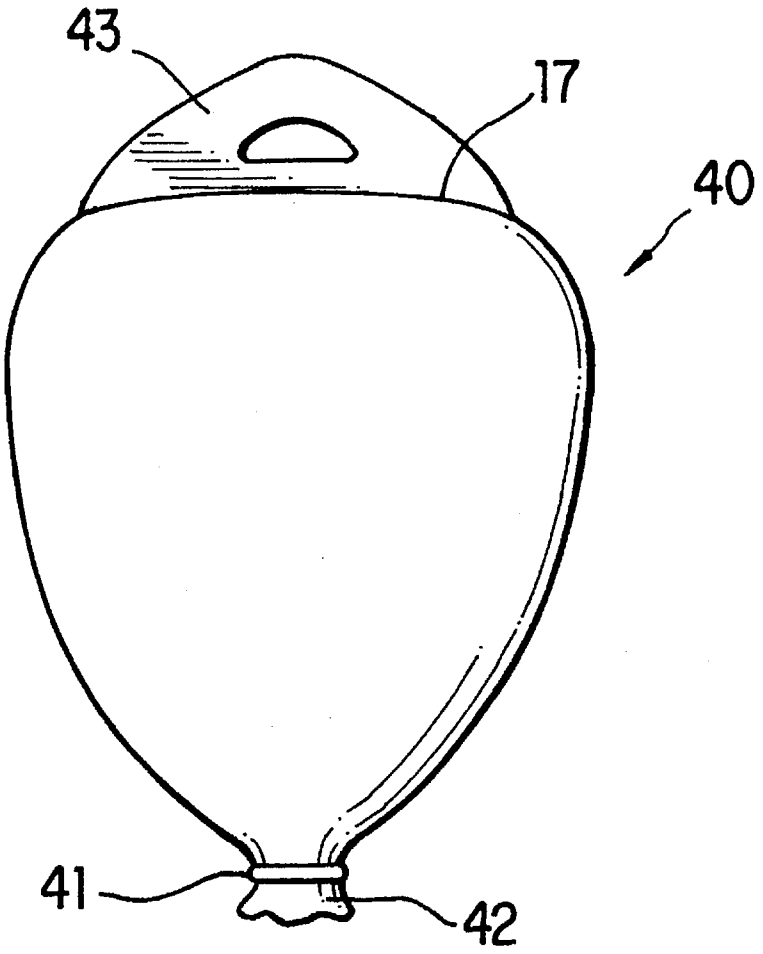
FIG. 4 is a schematic representation of the bag of FIG. 1 following heat shrinkage about a product vacuum sealed therein.

FIG. 4. shows a package generally indicated at 40 formed using the bag of FIG. 1. To this end a bird such as a turkey or the like is loaded breast first into the bag of FIG. 1 through open end 15. The breast portion of the bird generally fits and is received into the concave bottom of the bag pocket defined by heat seal 17. Next the bag is evacuated and the open end of the bag is gathered and is sealed, preferably by a metal clip 41 below the tail portion of the bird, also producing tag end 42 of bag 40. The sealed bag is then immersed in hot water or otherwise heated to shrink the bag about the bird (or other product) contained within the bag. It is to be appreciated by those skilled in the art that heat sealing shut of the open end of the bag may be used in place of the metal clip seal 41.

On heat shrinking, the bag material becomes tight to the bird to provide a smooth generally wrinkle-free package. Thus printing on the bag to identify the product and producer, as well as providing required labeling information, may be utilized without obscuring or truncating this printing due to wrinkles or folds in the bag.

While the heat shrinking of the bag has been described using hot water it its to be appreciated that any suitable heat shrinking means may be employed, including for example, hot water, hot air. Infrared radiation, RF radiation, steam and the like.

Also, on heat shrinking, the skin 18 material shrinks somewhat but remains positioned at the breast end of the bag 10 in a outwardly projecting attitude to permit the insertion of one's hand to grasp the handle 43. Thus, the handle stands away from the packaged product allowing for easy grasping of the handle and further, is easily recognized as a handle. The fact that a portion of the skirt is removed to produce the handle cut out and the skirt standing away from the packaged product makes the recognition of the handle obvious to the user. Subsequently, when the handle 43 is gripped and the package lifted, the handle 43 will stretch from the package, but will distribute the hanging load stress such that tear propagation is substantially eliminated.

The heat shrunk bag package 40 as shown in FIG. 4 is preferred for poultry such as turkeys and the like. In this respect, the handle 43 is located at the breast of the bird which provides protection of the valuable breast area from damage due to striking hard surfaces, such as counters and the like, during display by the retailer and transportation and preparation by the consumer.

Figure 5:
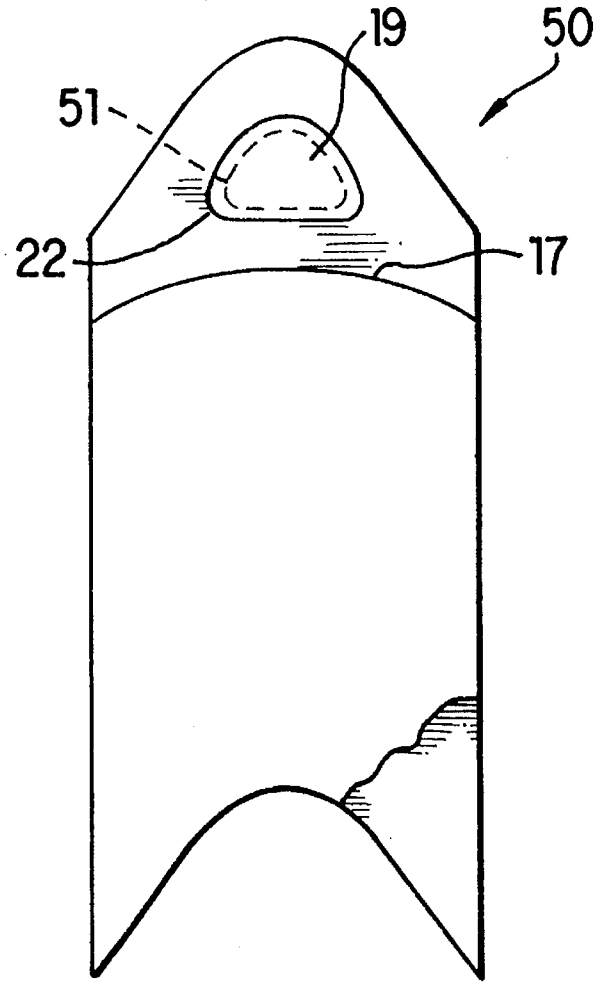
FIG. 5 Is a schematic front view of an embodiment of a heat shrinkable extended lip bag having the generally D shaped handle cut out with the cut out held in place by a row of perforations such that the cut out remains in place during bag production, packaging of the product and heat shrinking and is then removable to allow use of the handle feature for transporting the packaged product. An optional heat seal surrounding the row of perforations is also shown.

In the bag of FIG. 1, the handle cut out 19 is removed during the formalon of the heat seal 20 around the periphery of the handle cut out 19. This cut out can allow the bag 10 to interfere with the automatic or manual handling of the bag 10. Accordingly, in order to maintain this skirt 18 without interfering with the loading of bag 10, FIG. 5 shows an embodiment of the present invention 50 wherein the handle cut out 19 is formed via a line of perforations. This allows for ease of handling during bag production and product packaging while still providing a handle assembly for ease of transportation of the packaged product. Preferably, the spacing of the perforations 51 is such that upon heat shrinking, the shrink induced stresses are sufficient to separate the handle cut out 19 by tearing along the line of the perforations 51. Otherwise, the separation can be accomplished by manually tearing along the line of perforations. Thus, by removing the handle cut out 19 along perforation line 51 a carrying handle of the present invention is realized. A heat seal 22, of the type of heat seal like heat seal 17, may optionally be placed to surround perforation line 51 in the same general shape thereof to allow for added strength when the handle cut out 19 is removed. Perforations 51 and heat seal 22 are preferably generally concentric, with heat seal 22 outside of and surrounding handle cut out 19.

For retail purposes, it often is dealtable to attach a tag to the bagged product on which is written the weight, cost or other relevant information regarding the product. Generally, this tag is attached after packaging. However, is to be understood that such a tag may be attached during the bag manufacturing process. The tag preferably is of a heat sealable plastic film which has little or no heat shrink properties. This allows the entire area of the as-attached tag to be used for later-applied information such as the weight and price of the product contained in the shrink bag package. A suitable plastic film for this purpose has been found to be a sheet of spun bonded linear polyethylene fiber as sold by DuPont under the brand name TYVEK.

Preferably, the tag should be positioned so it does not obscure the handle cut out area of the skirt. This is to avoid blocking the easy entry of one's hand into the handle cut out and thereby allow for the safe and easy transportation and handling of the packaged product. This tag may be attached to the heat seal forming the bottom of the bag during its formation in which case the tag is located so that it does not cover the handle cut out. The tag may also be attached to the edge of the skirt at the heat seal which seals the outside edge of the skirt during the formation of the heat seal. Again the tag should be positioned such that it does not interfere with the handle cut out.

Also, for retail purposes it is sometimes desirable to have the appearance of a netting over the packaged product. In this regard it is understood that a netting pattern may be preprinted on the plastic sheet or tubing prior to the bag manufacturing process making the bag of the present invention. This printed netting pattern may be of any desired design, but preferably is designed to simulate the net overwrap used on some packaging to provide a carrying handle. Thus, this embodiment of the present invention provides a carrying handle without the cost associated with a separate netting and consequent processing steps necessary, to provide the netting around the packaged product while at the same time providing the consumer with the visual effect of the netting.

Several different handle cut out shapes were made in heat shrinkable bags using gasket punches. These shapes included those with sharp corners, rounded comers, circles, rectangles, silts and included single cut out hole and multiple cut out hole configurations. The bags were each shrunk for approximately 3 seconds in a 205° F. hot water bath. The shrunk bags were then placed on a pull tester which clamped the bottom of the bag, and had plastic pegs which acted as fingers when inserted into the handle cut out(s). The "fingers" were then pulled up by a pneumatic cylinder, the rate at which the handle was pulled was not controlled, but was uniform. A strain gauge was mounted to the handle tester and recorded the maximum force on the test fingers during the pull. The test results indicated that the strength of the handle was severely degraded when the configuration of the handle cut out included sharp comers or slits. The handle cut out geometries which included sharp corners and slits, on average, had a peak handle force to failure of approximately 7 pounds. On the other hand, handle cut out geometries having smooth shapes had, on average, a peak handle force to failure of approximately 28 pounds.

A second set of bags, some having the D shape of the present invention, and some having an elongated slit configuration were produced using gasket punches. All of the bags were without sharp corners, or open cuts. Each bag had a 14 to 16 pound turkey vacuum packaged inside, breast toward the handle, then dipped into a 205° F. shrink tank for 3 seconds. The bags and turkeys were then frozen. The packages were then held approximately six feet above the ground and allowed to free fall until jerked to a stop at waist height. This was done by hand in each case. The bags continued to be dropped and bounced until the handles broke or until the tester determined that the handle was not going to break. The results were that the significant majority of D shaped handles survived the test without breaking and the significant majority of elongated slit handles failed.

Although the illustrative embodiments of the present invention have been described herein with reference to the accompanying drawings it is to be understood that the invention is not limited to those precise embodiments, and that various other changes and modifications may be effected therein by one skilled in the art without departing from the scope or spirit of the invention.

What is claimed is:

1. A thermoplastic bag comprising:

a) congruent front and rear panels of a thermoplastic material superimposed one against the other and defining a front and rear of a bag pocket, the panels having longitudinal side edges joined to form bag pocket side edges, and the panels having common ends in communication with the longitudinal side edges, and including:

(i) a first end adjacent to but longitudinally spaced from a closed bottom of the bag pocket, and (ii) an opposite end;

b) a continuous transverse heat seal connecting the front and rear panels adjacent to but spaced from the first end, the heat seal defining the closed bottom of the bag pocket;

c) a skirt defined by the front and rear panels between the first end and the transverse heat seal;

d) the skirt having a generally D shaped handle cut out having a linear portion , the linear portion of the D disposed substantially parallel to the transverse heat seal, and wherein the handle cut out has (i) an end arc formed by the major curve of the D, the end arc curved toward the first end, (ii) a first side arc formed by the juxtaposition of one end of the major curve of the D with one end of the linear portion of the D, and (iii) a second side arc formed by the juxtaposition of the other end of the major curve of the D with the other end of the linear portion of the D;

the shape further defined by (i) the end arc having a radius (A) of from about (1.75×R) to about (2.25×R), (ii) the first side arc having a radius of about (R), and (iii) the second side arc having a radius of about (R), wherein R is at least about 1 inch; and wherein the distance between the end arc and the first end is at least 0.5 inches.

2. The bag of claim 1 wherein the transverse heat seal is contoured to accommodate a food product.

3. The bag of claim 1 wherein the thermoplastic material comprises a stretch oriented non-oxygen barrier heat shrinkable thermoplastic material.

4. The bag of claim 1 wherein the thermoplastic material comprises a stretch oriented oxygen barrier heat shrinkable thermoplastic material.

5. The bag of claim 1 wherein the panels are heat sealed together around the handle cut out.

6. The bag of claim 1 wherein the first end has a transverse heat seal.

7. The bag of claim 5 wherein the heat seal around said handle cut out is produced in a step separate from a step of producing the handle cut out.

8. The bag of claim 1 wherein the handle cut out is defined by a plurality of spaced perforations.

9. The bag of claim 8 wherein the perforations are surrounded by a heat seal.

10. A method of making a thermoplastic bag having an integral carrying handle comprising:

a) providing congruent front and rear bag panels of a thermoplastic material superimposed one against the other, the panels having longitudinal side edges joined to form bag pocket side edges, and the panels having common ends in communication with the longitudinal side edges, and including a first end and an opposite end;

b) heat sealing the bag panels together to form a continuous transverse heat seal adjacent to but spaced apart from the first end, the seal defining a closed bottom of the bag pocket, and the panels between the seal and the first end defining a skirt;

c) cutting a generally D shaped handle cut out in the skirt, the handle cut out having a linear portion, the linear portion of the D disposed substantially parallel to the transverse heat seal, and wherein the handle cut out has (i) an end arc formed by the major curve of the D, the end arc curved toward the first end, (ii) a first side arc formed by the juxtaposition of one end of the major curve of the D with one end of the linear portion of the D, and (iii) a second side arc formed by the juxtaposition of the other end of the major curve of the D with the other end of the linear portion of the D;

the shape further defined by (i) the end arc having a radius (A) of from about (1.75×R) to about (2.25×R), (ii) the first side arc having a radius of about (R), and (iii) the second side arc having a radius of about (R), wherein R is at least about 1 inch; and wherein the distance between the end arc and the first end is at least 0.5 inches.

11. The method of claim 10 wherein the transverse heat seal is contoured to accommodate a food product.

12. The method of claim 10 wherein the thermoplastic material comprises a stretch oriented non-oxygen barrier heat shrinkable thermoplastic material.

13. The method of claim 10 wherein the thermoplastic material comprises a stretch oriented oxygen barrier heat shrinkable thermoplastic material.

14. The method of claim 10 wherein the panels are heat sealed together around the handle cut out.

15. The method of claim 14 wherein the heat seal around the handle cut out is produced simultaneously with the production of the handle cut out.

16. The method of claim 14 wherein the heat seal around the handle cut out is produced in a step separate from the step of producing the handle cut out.

17. The method of claim 10 further providing heat sealing the first end to form a transverse heat seal.

18. A thermoplastic bag comprising:

a) congruent front and rear panels of a thermoplastic material superimposed one against the other and defining a front and rear of a bag pocket, the panels having longitudinal side edges joined to form bag pocket side edges, and the panels having common ends in communication with the longitudinal side edges, and including:

(i) a first end adjacent to but longitudinally spaced from a closed bottom of the bag pocket, and (ii) an opposite end;

b) a continuous transverse heat seal connecting the front and rear panels adjacent to but spaced from the first end, the heat seal defining the closed bottom of the bag pocket;

c) a skirt defined by the front and rear panels between the first end and the transverse heat seal;

d) the skirt having, before heat shrinking, a circular handle cut out which, upon heat shrinking the bag around a food product, forms a generally D shaped handle cut out having a linear portion, the linear portion of the D disposed substantially parallel to the transverse heat seal, and wherein the handle cut out has (i) an end arc formed by the major curve of the D, the end arc curved toward the first end, (ii) a first side arc formed by the juxtaposition of one end of the major curve of the D with one end of the linear portion of the D, and (iii) a second side arc formed by the juxtapostion of the other end of the major curve of the D with the other end of the linear portion of the D;

the shape further defined by (i) the end arc having a radius (A) of from about (1.75×R) to about (2.25×R), (ii) the first side arc having a radius of about (R), and (iii) the second side arc having a radius of about (R), wherein R is at least about 1 inch; and wherein the distance between the end arc and the first end is at least 0.5 inches.

19. A method of making a thermoplastic bag having an integral carrying handle comprising:

a) providing congruent front and rear bag panels of a thermoplastic material superimposed one against the other, the panels having longitudinal side edges joined to form bag pocket side edges, and the panels having common ends in communication with the longitudinal side edges, and including a first end and an opposite end;

b) heat sealing the bag panels together to form a continuous transverse heat seal adjacent to but spaced apart from the first end, the seal defining a closed bottom of the bag pocket, and the panels between the seal and the first end defining a skirt;

c) cutting a circular shaped handle in the skirt, which upon heat shrinking the bag around a food product, forms a generally D shaped handle cut out in the skirt, the handle cut out having a linear portion, the linear portion of the D disposed substantially parallel to the transverse heat seal, and wherein the handle cut out has (i) an end arc formed by the major curve of the D, the end arc curved toward the first end, (ii) a first side arc formed by the juxtaposition tion of one end of the major curve of the D with one end of the linear portion of the D, and (iii) a second side arc formed by the juxtaposition of the other end of the major curve of the D with the other end of the linear portion of the D;

the shape further defined by (i) the end arc having a radius (A) of from about (1.75×R) to about (2.25×R), (ii) the first side arc having a radius of about (R), and (iii) the second side arc having a radius of about (R), wherein R is at least about 1 inch;

wherein the distance between the end arc and the first end is at least 0.5 inches.

20. A package made from the bag of claim 1.

21. A package made from the bag of claim 18.

* * * * *